US005938398A

United States Patent [19]

Brown

[11] Patent Number: 5,938,398

[45] Date of Patent: Aug. 17, 1999

[54] DISPENSING BUCKET APPARATUS

[75] Inventor: Rodney E. Brown, Santa Fe, Tex.

[73] Assignee: Akard & Griffin

[21] Appl. No.: 08/948,289

[22] Filed: Oct. 10, 1997

Related U.S. Application Data

[63] Continuation-in-part of application No. 08/833,402, Apr. 4, 1997, Pat. No. 5,829,949.

[51] Int. Cl.[6] ..... B28B 13/00

[52] U.S. Cl. ..... 414/607; 414/608; 414/725; 37/903

[58] Field of Search ..... 414/607, 608, 414/422, 425, 526, 725, 912, 685; 37/141, 903; 141/10; 222/412, 413, 608

[56] References Cited

U.S. PATENT DOCUMENTS

| | | | |
|---|---|---|---|
| 2,597,692 | 5/1952 | Wills et al. . | |
| 3,279,763 | 10/1966 | Seman | 414/608 |
| 3,318,486 | 5/1967 | Felix . | |
| 3,598,266 | 8/1971 | Fisher . | |
| 4,068,771 | 1/1978 | Zimmerman | 414/722 |
| 4,334,820 | 6/1982 | Hamura | 414/607 |
| 4,405,278 | 9/1983 | Kvalheim | 414/608 |
| 4,782,606 | 11/1988 | Surface . | |
| 4,798,510 | 1/1989 | Lazenby . | |
| 5,114,296 | 5/1992 | Badder | 414/607 |
| 5,182,057 | 1/1993 | Johnson | 414/608 |

FOREIGN PATENT DOCUMENTS

| | | | |
|---|---|---|---|
| 2609697 | 7/1988 | France | 414/608 |

*Primary Examiner*—Karen M. Young
*Assistant Examiner*—Gregory A Morse
*Attorney, Agent, or Firm*—Jeffrey E. Griffin

[57] ABSTRACT

A dispensing bucket apparatus that removably connects to a loader vehicle. The apparatus is a bucket that is adapted to receive and hold a flowable material and has an exit opening in its front end that is selectively opened and closed by a gate. The position of the gate may be controlled by the user from within the loader vehicle to control the flow and flow rate of the flowable material from the bucket. The side walls of the bucket converge toward the front of the bucket and form a funnel that directs the flowable material to the exit opening. The construction of the apparatus is such that the user can view the pour at all times and, thereby, reduce spillage and waste. An alternate embodiment includes a tilting mechanism that provides for attachment of the bucket to a forklift and for tilting of the bucket. A removable chute allows the pour opening to be extended further from the front of the bucket.

16 Claims, 4 Drawing Sheets

DISPENSING BUCKET APPARATUS

This is a continuation-in-part of U.S. application Ser. No. 08/833,402, filed Apr. 4, 1997 and now U.S. Pat. No. 5,829,949.

BACKGROUND OF THE INVENTION

Field of Invention

This invention relates to a loader vehicle attachment for dispensing a flowable liquid. More specifically, it is directed to a low cost dispensing bucket apparatus that attaches directly to the frame arms of a loader vehicle and that may include a tilting mechanism.

When spreading flowable materials such as concrete, the material must cover a specific broad area, the pour site. Typically however, the trucks carrying the material are unable to reach the pour site and are unable to properly distribute the material. In such a case, the distribution of the flowable material typically requires the use of wheelbarrows and substantial manpower. Due to physical limitations, each wheelbarrow can transport a limited amount of material. Accordingly, the labor costs and time required for completing a pour are substantial. Additionally, because materials such as concrete cure rapidly, failure to complete the pour rapidly may result in wasted material or a faulty pour. Thus, a relatively fast distribution of the material reduces the risk of material waste and a faulty pour.

As used herein, loader vehicles include "skid-steer" loaders, backhoes, forklifts, sky-lifts, track-hoes, tractor loaders and other vehicles that include a hydraulic system and that are capable of removably receiving an attachment thereon. For ease of description, the following discussion will primarily focus on skid-steer loaders. However, other types of loader vehicles are addressed from time to time.

Generally, skid-steer loaders are vehicles designed to operate in rough terrain and perform a variety of functions. The loader vehicles include loader frame arms that extend in front of the loader vehicle and that may be raised and lowered by hydraulic cylinders. The same hydraulic power system that operates the frame arms may also operate auxiliary equipment on the loader vehicle. The ends of the frame arms include releasable attachments that permit rapid connection of auxiliary equipment to the loader vehicle. Also, the attachment enables tilting of the auxiliary equipment.

Consequently, the skid-steer loaders have evolved into multi-function vehicles as more and more attachments for the loader vehicles have been designed. Examples of attachments include dumping buckets, stump grinders, sweepers, trenchers, backhoes, angle blades, pallet forks, among many others.

Also included among the skid-steer loader attachments is a standard dumping bucket. The loader vehicle may tilt the dumping bucket downward to scoop material therein and to dump material therefrom and may tilt the bucket upward to hold the material. Because the bucket walls are sealably connected, the bucket can carry a flowable material. However, the walls of the bucket are typically slanted to facilitate scooping. Thus, spillage of a flowable material is common. Also, when pouring from the bucket, the flowable material tends to splash resulting in additional wasted material. Perhaps the most important shortfall of the bucket in pouring a flowable material, results from elongated design of the bucket. Generally, the buckets extend the full width of the loader vehicle to promote more efficient scooping of material and increased capacity. Completing a pour, however, frequently requires precision in directing the flowable material to the pour site. Often the desired pour location is a small or narrow area such as a post hole. Accordingly, the standard dumping bucket cannot complete a large number of the jobs involving a flowable material.

Like the skid steer loaders, the other loader vehicles typically include loader frame arms that extend in front of the loader vehicle and that may be raised and lowered by hydraulic cylinders. They include a hydraulic power system that may operate auxiliary equipment on the loader vehicle. In addition, they typically have releasable attachments that permit rapid connection of auxiliary equipment to the loader vehicle. Also, the attachment enables tilting of the auxiliary equipment.

Many forklifts are now designed for rough terrain and many include tilting mechanisms. Further, a number of forklifts have been adapted to receive auxiliary equipment that may be actuated using the hydraulic system of the forklift. However, not all forklifts have mechanisms that provide adequate tilting of attachments, such as the dispensing bucket apparatus. Accordingly, there is a need for a tilting apparatus that facilitates tilting of auxiliary equipment attached to the forklift so that, in the case of the dispensing bucket apparatus, the pouring of the flowable material is more effective.

SUMMARY OF THE INVENTION

The invention relates to a dispensing bucket apparatus that has a bucket having an upper portion adapted to receive a flowable material therein and an exit opening that is sufficiently large to permit the flowable material to exit therethrough. A gate means provides for the selective opening and closing of the container and adjustment of the opening size. The bucket is adapted for attachment to a loader. When attached, a gate control means facilitates actuation and adjustment of the position of the gate means by a user from within the loader vehicle.

The present invention also relates to a dispensing bucket apparatus that has a bucket and gate means as described above. The bucket has a peripheral wall and a substantially flat bottom; the exit opening extends to the bottom of the bucket; and the gate means opens from the bottom. In this way, the bucket is emptied proximal the bottom of the bucket. Also, the wall is sufficiently short so that the user can see into the bucket when the bucket if in the lowered position. Due to the flat bottom, the user can see the flowable material exiting the bucket through the exit opening.

The present invention also relates to a dispensing bucket apparatus that has a bucket and gate means as described above. The bucket has a back wall and two side walls that form a peripheral wall. The side walls converge linearly toward one another from opposing ends of the back wall to the exit opening. Thus, for a given bucket length, the side walls form the greatest possible angle with the back wall.

The present invention also relates to a dispensing bucket apparatus that has a bucket and gate means as described above. The gate means is a gate that extends the full length and height of the exit opening and slides in vertical slots disposed in the side walls.

The present invention also relates to a method of delivering a flowable material that includes attaching a bucket to a loader vehicle, placing the flowable material in the bucket, driving the loader vehicle to the delivery site, and controlling the gate means of the bucket from within the loader vehicle to control the dispensing of the flowable material.

The present invention also relates to a method for forming structures that comprises forming a mold having a pour opening for the concrete structure, attaching to a loader vehicle a bucket having an upper open portion adapted to receive the concrete therein, an exit opening that is sufficiently large to permit the concrete to exit therethrough, and an adjustable gate means for selectively opening and sealingly closing the exit opening and controlling the size of the exit opening when the exit opening is open, placing the concrete in the bucket, driving the loader vehicle to the desired delivery site and positioning the exit opening over the pour opening of the mold, controlling the gate means from within the loader vehicle to control the flow and flow rate of the flowable material from the bucket into the mold, and removing the mold from around the concrete structure after the concrete has set.

The present invention also relates to a method for controlling the flow of a flowable material from a bucket that has an upper open portion adapted to receive a flowable material therein and an exit opening that is sufficiently large to permit the flowable material to exit therethrough and that is attached to a loader vehicle that comprises selectively opening and sealingly closing the exit opening and controlling the size of the exit opening when the exit opening is open using a gate, actuating the gate and controlling the position of the gate—and, thus, the size of the exit opening—from within a loader vehicle when the bucket is functionally attached to the loader vehicle using a hydraulic cylinder attached to the gate and actuated by a hydraulic power system of the loader vehicle.

BRIEF DESCRIPTION OF THE DRAWINGS

The manner in which these objectives and other desirable characteristics can be obtained is explained in the following description and attached drawings in which.

DETAILED DESCRIPTION OF THE INVENTION

Figure 1:
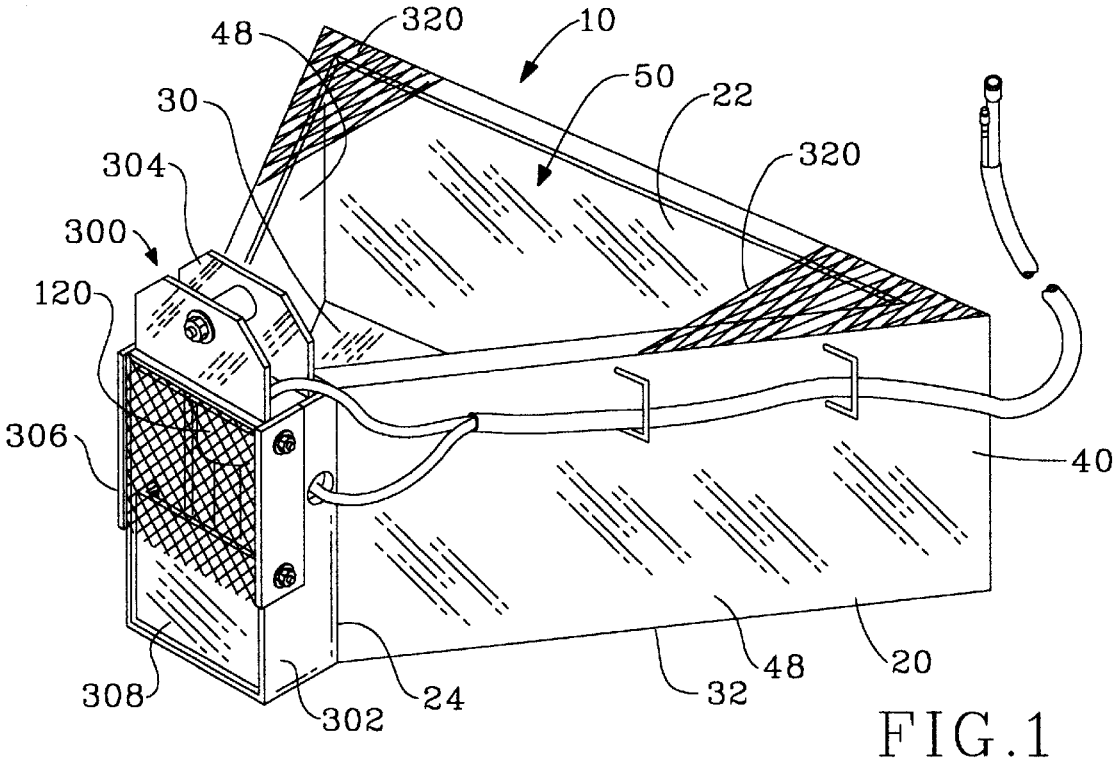
FIG. 1 is an isometric view of the dispensing bucket apparatus.

The preferred embodiment of my invention is illustrated in FIGS. 1 through 11 and the dispensing bucket apparatus is depicted as 10. Generally, the dispensing bucket apparatus 10 is a bucket adapted to receive a flowable material therein. It has an exit opening 60 that may be selectively opened and closed by a gate means 68 and the bucket 20 is adapted for attachment to a loader vehicle 110. An optional tilting mechanism 500 for use with forklifts facilitates pouring. Likewise, an optional removable chute 600 helps move the pour position further from the loader vehicle 110. A more detailed description of the apparatus 10 and the figures follows.

As stated previously, loader vehicles, as used herein, include "skid-steer" loaders, backhoes, forklifts, sky-lifts, track-hoes, tractor loaders and other vehicles that include a hydraulic system and that are capable of removably receiving an attachment thereon.

The dispensing bucket apparatus 10 is removably attachable to a loader vehicle 110. An operator of the loader vehicle 110 sits within a loader vehicle cab 112. The loader vehicle 110 of the skid steer or other typical loader types—as opposed to a forklift—includes lifting arms (referred to herein as the "loader frame" 114) that extend in front of the loader vehicle 110 and that may rotate to a variety of raised and lowered positions. A hydraulic power system 118 of the loader vehicle 110 provides the power for raising and lowering the loader frame 114 and for tilting any auxiliary equipment attached to the loader frame 114. A loader frame control means 117 provides for control of lifting the loader frame and tilting of any attached auxiliary equipment. The extreme forward end of the loader frame 114, the frame apogee end 116, includes releasable attachments that securely fasten auxiliary equipment to the loader vehicle 110. Using skid steer loaders as an example, for proper fastening, the auxiliary equipment need only include the proper lips and connecting holes to attach to the standard loader vehicle connectors. These loader vehicle connectors allow for relatively fast connection and disconnection of the auxiliary equipment. From within the loader vehicle cab 112 (also referred to herein as simply "within the loader vehicle 110"), the operator may control the movement of the loader vehicle 110 as well as the hydraulic power system 118 and loader frame 114 using the loader frame control means 117.

An attachment means 90 provides selective, removable attachment of the bucket 20 to the loader vehicle 110. As described previously, the loader vehicle 110 includes connectors proximal the frame apogee end 119 of the loader frame 114. Accordingly, the attachment means 90 may merely comprise the loader vehicle connectors and matching connectors secured to the bucket 20. The attachment means 90 and connectors permit the bucket 20 to tilt relative to the loader frame 114. These connectors are known to those skilled in the art.

Likewise, many forklifts and the like have been adapted so that auxiliary attachments may be connected to them and they are constructed to permit tilting of the lifting blades and, thus, any attached equipment. A operator sitting within and controlling the forklift can adjust the height of the attached equipment as well as the relative tilt of the attached equipment. However some forklifts do not provide adequate tilting for the dispensing bucket apparatus 10 to allow proper, efficient pouring of the flowable material. Dispensing bucket apparatuses 10 for these forklifts include a tilting mechanism 500 to facilitate pouring.

"Flowable material" includes any material that is capable of flowing or moving through the relatively narrow exit opening. Examples of flowable materials include, inter alia, concrete, mud, sand, dirt, rocks, grain, feed, nuts, bolts, nails, and the like.

The bucket 20 has an upper open portion 50 adapted to receive a flowable material therein and an exit opening 60 that is sufficiently large to permit the flowable material to exit therethrough. The bucket 20 has a bottom 30, a front 24, and a back 22. Extending upwardly from a perimeter 32 of the bottom 30, preferably at a right angle, is a peripheral wall 40. The wall 40 and the bottom 30 are sealably connected at the wall bottom end 44 and define an upper open portion 50 in the bucket 20. In addition, the bottom 30 and the wall 40 define an exit opening 60 in the bucket 20. To permit the flowable material to rapidly exit through the exit opening 60, the exit opening 60 is relatively large. A gate 70 connected to the bucket 20 seals the exit opening 60 when closed so that the bucket 20 can receive and maintain a flowable material in the bucket 20.

In the preferred embodiment the bucket 20 has a back 22 and two side walls 48 that form the peripheral wall 40. Although the forks of a forklift may be used to support and hold the bucket 20, typically the back 22 of the bucket 20 is adapted to be removably affixed to a loader vehicle 110 so that the rearward end of the bucket 20 attaches to the loader vehicle 110. Opposite the back 22 is the front 24. The side walls 48, sealingly connected to opposite ends of the back 22, linearly converge toward one another from the back 22 toward the front 24 and the exit opening 60. In this way, the bucket 20 narrows from the back 24 to the front 22. At the front 24, the side walls 48 preferably do not meet or touch. To the contrary, the bottom 30 and the side walls 24 define the exit opening 60 at the front 24. Thus, the gate 70 is at the front 24. With this design, the back 22, the side walls 48, and the gate 70 form a trapezoidal shaped bucket 20. With a trapezoidal shape, the side walls 48 act as a type of funnel that directs the flowable material to the exit opening 60. Because the side walls 48 are substantially straight (i.e. planar), the bucket 20 does not include any obstructions that restrict the flow of the flowable material to the exit opening 60. Using this preferred construction, the side walls 48 extend from the back 22 at the greatest possible angle for a bucket 20 having a fixed length from the back 22 to the exit opening 60 and, therefore, utilizes the pressure exerted by the flowable material against the side walls 48 to force the flowable material through the exit opening 60 in the most efficient manner possible. An added advantage to the trapezoidal shape of the bucket 20 is that the shape causes the center of mass and the moment of inertia to be closer to the loader vehicle 110 than a bucket that does not have angled sides throughout its full length. Consequently, the weight is closer to the loader vehicle 110 for a bucket 20 having a given length and allows the bucket 20 to be longer. This places the exit opening 60 further from the loader vehicle 110 and allows the bucket 20 to pour further from the loader vehicle 110. Stated another way, the increased length increases the reach of the bucket 20. Also, moving the weight closer to the bucket 20 reduces the risk of tipping of the loader vehicle 110 when the bucket 20 is full and, thereby, facilitates use of a higher capacity for the bucket 20.

So that the exit opening 60 is centrally positioned in the front of the bucket 20, the angles formed between the back wall 22 and each of the side walls 48 are equal. Preferably, the exit opening 60 extends to the bottom 30 of the bucket 20 so that the bucket 20 may be emptied proximal its bottom 30.

Also, the preferred embodiment includes a pair of triangular steps 320 proximal the back 22 of the bucket 20 at the top end 42 of the peripheral wall 40 that the user may use when entering and exiting a loader vehicle 110 that has its door in the front. These steps 320 provide additional support for the bucket 20 and increase its rigidity and strength.

The exit opening 60 may be selectively opened and closed using a gate means 68. Preferably, the gate means 68 is actuated by a gate control means 100 that the operator controls from within the loader vehicle 110. The gate means 68 provides for selective opening and sealed closing of the exit opening 60 and provides for control of the size of the exit opening 60 when the exit opening 60 is open. The gate 70 has a top end 72, a gate bottom 74, and two opposing gate sides 76. In the preferred embodiment, the bucket 20 has a pair of vertically extending slots 82, one on each side of the exit opening 60 (at the front end of the side walls 48). Each vertically extending slot 82 has sufficient width to slidably receive one of the gate sides 76 therein. Therefore, the vertically extending slots 82 hold both sides 76 of the gate 70 and support the gate 70 therebetween. The gate 70 extends between and is slidably positioned within the slots 82. Thus, the gate 70 slides vertically in the slots 82 to selectively open and close the exit opening 60 and to control the size of the exit opening 60 when it is open. With this configuration, the gate means 68 opens from the bottom and, thereby, empties the bucket 20 proximal the bottom 30 of the bucket 20. The gate 70 may slide completely to the bottom of the exit opening 60 and into contact with the bottom 30 of the bucket 20 and seal, or close, the exit opening 60. As the gate 70 may slide from the closed position to any other position up to its upper limit, the gate 70 may vary the size of the exit opening 60 and regulate the flow rate through the exit opening 60.

Figure 4:
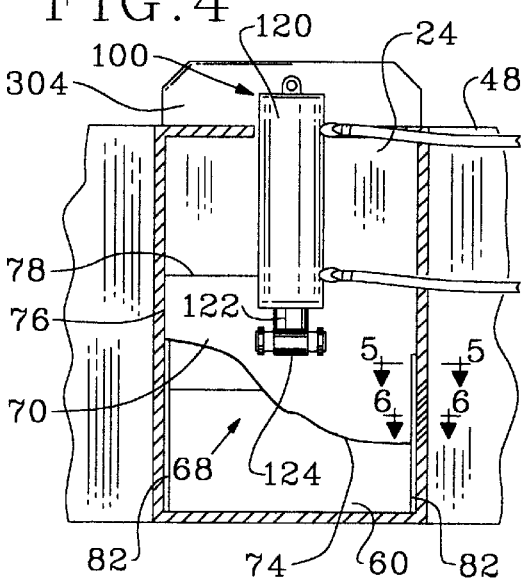
FIG. 4 is a partial, cross sectional, elevation view of the front dispensing bucket apparatus.
Figure 5:
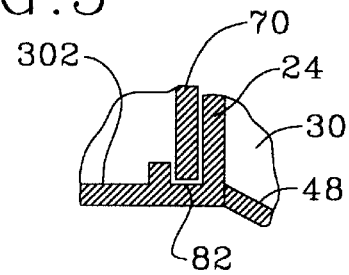
FIG. 5 is a partial, cross sectional view of the slot and the gate.
Figure 6:
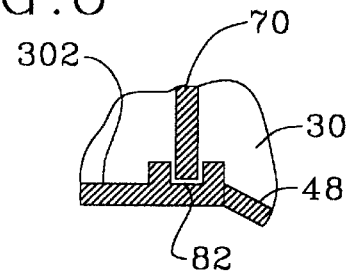
FIG. 6 is a partial, cross sectional view of the slot and the gate.
Figure 7:
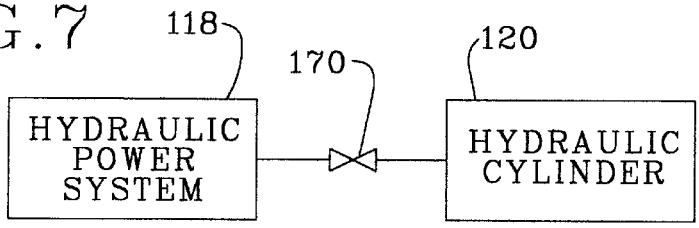
FIG. 7 is a schematic of the hydraulic system and controls of the dispensing bucket apparatus.
Figure 8:
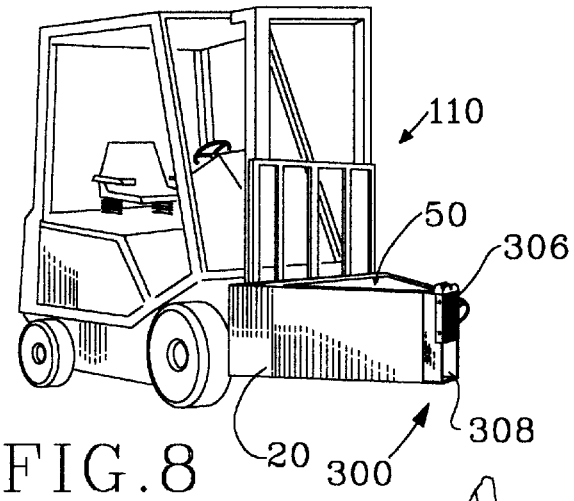
FIG. 8 is an isometric view of the dispensing bucket apparatus attached to a forklift.

As shown in FIGS. 4 and 5, the bucket 20 may include an actual front 24 against which the gate 70 slides. The sliding abutment of the gate 70 and the front 24 prevents flowable material from flowing therebetween. In this design, the front 24 provides an upper limit to the exit opening 60. Also, as shown in FIG. 5, the front 24 forms a back limit for the slot 82. A separate protrusion forms the forward limit for the slot 82. In addition, a protrusion extends below the front 24, as shown in FIG. 6, to define the back limit for the slot all the way to the bottom 30 of the bucket 20.

In the preferred embodiment, the gate control means 100 facilitates user control of the position of the gate 70 and, thus, the size of the exit opening 60 from within the loader vehicle cab 112 when the dispensing bucket apparatus 10 is functionally attached to the loader vehicle 110. It provides for actuating the gate means 68 and controlling the position of the gate means 68. Although the gate control means 100 may use an electric power supply or some other power supply, the gate control means 100 preferably utilizes the hydraulic power system 118 of the loader vehicle 110. In this preferred design, the gate control means 100 includes, generally, at least one hydraulic cylinder 120 having a movable ram 122 that is connected to the gate 70 such that movement of the ram 122 causes movement of the gate 70 and having a user controlled valve 170. The hydraulic cylinder 120 is mounted on the bucket 20. When the dispensing bucket apparatus 10 is functionally connected to the loader vehicle 110, the hydraulic cylinder 120 is in flow communication with and is controlled by the hydraulic power system 118 of the loader vehicle 110. A user within the loader vehicle 110 controlling the hydraulic power system 118 may, thus, control the hydraulic cylinder 120 and the ram 122 and the movement and position of the gate means 68.

Figure 2:
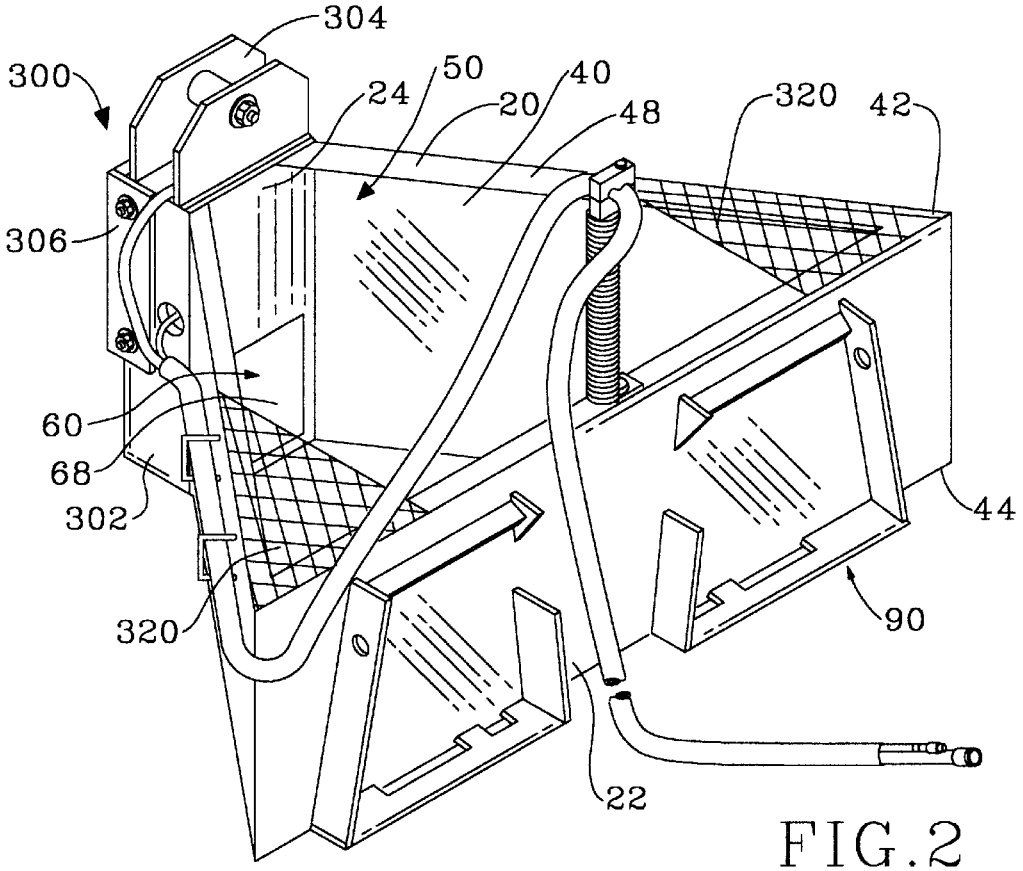
FIG. 2 is an isometric view of the dispensing bucket apparatus.

The preferred embodiment is best shown in FIGS. 1, 2 and 4 and uses the sliding gate 70 construction. In this embodiment, the back of the hydraulic cylinder 120 is pivotally connected to the bucket 20 and extends in a vertically downward direction from the connection. The hydraulic cylinder 120 is positioned at the front 24 of the bucket 20 directly in front of the gate 70 and the exit opening 60, preferably at the lateral center of the gate 70 and the exit opening 60. The apogee end 124 of the ram 122 is connected to the gate 70—preferably near the center of the gate 70. Consequently, movement of the ram 122 produces a vertical sliding movement of the gate 70.

Using this preferred construction places the hydraulic cylinder 120 at a forward position where it is likely to be easily damaged. Accordingly, as shown in the figures, the bucket 20 includes a guard means 300 for encasing and protecting the hydraulic cylinder 120 while still permitting the flow of flowable material from the bucket 20. The guard means 300 shown has a guard chute 302 that extends from the front of the bucket 20 and has a front exit, a top, a bottom, and a pair of sides. The guard chute 302 has a height at least as great as the height of the bucket and a width at least as great as the width of the exit opening 60. Of course, the guard chute 302 is wide enough to accommodate the hydraulic cylinder therein. Thus, the guard chute 302 encircles the exit opening 60 and the gate 70. So that the flowable material may still exit the bucket 20, the guard chute 302 defines a cavity through which the flowable material may flow. The bottom 22 of the bucket 20 and the bottom of the guard chute 302 are level with one another to further facilitate ease of flow of flowable material from the bucket 20. The gate 70 is constructed so that when it is fully opened it does not contact the top of the guard chute 302. The hydraulic cylinder 120 is attached to a cylinder mounting bracket 304 attached to the top of the guard chute 302 and extends downward through a hole defined in the top of the guard chute 302. To ensure protection of the hydraulic cylinder 120, the length of the guard chute 302 is necessarily long enough to enclose the hydraulic cylinder 120 therein.

The front of the guard chute 302 is, preferably at least partially covered. As shown, a porous front cover 306 extends the full width of the of the front exit of the guard chute 302 and covers at least a portion of its height. To facilitate cleaning and maintenance, the front cover 306 is removably mounted and porous. As shown in the figures, the front cover 306 is a grid having a plurality of large voids. This porous construction facilitates ease of cleaning by allowing water to be sprayed therethrough to clean the hydraulic cylinder 120, gate 70, and other components within the guard chute 302. Covering the lower portion of the front exit is a flapper door 308 that extends the full width of the exit opening and has a height approximately equal to the height of the exit opening 60. The flapper door 308 and the front cover 306 provide additional safety because they prevent hands and other objects such as shovels from entering the guard chute 302. The top of the flapper door 308 is connected to the front exit of the guard chute 302 by a hinged connection intermediate the top and bottom of the guard chute 302. The flapper door 302 extends downward so that its bottom is proximal the bottom of the guard chute 302. However, to prevent sticking of the flapper door 308 there is preferably a small space between the bottom of the flapper door 308 and the bottom of the guard chute 302. The front cover 306 covers the portion of the front exit of the guard chute 302 not covered by the flapper door 308. Like the front cover 306, the flapper door 308 is removably attached to the guard chute 302. When the gate 70 is raised, the flowable material flows through the exit opening 60, through the cavity of the guard chute 302, forces the flapper door 308 open, and exits the bucket 20. In addition, the flapper door 308 is limited in its rearward rotation and travel. If pushed backward into the guard chute 302, the flapper door 308 is sufficiently long that it will impact the apogee end 124 of the ram 122 or the brackets connecting it to the gate 70. This limitation on the rearward movement of the flapper door 308 provides additional safety for the user by helping to keep foreign objects out of the guard chute 302 and, thereby, also protecting the hydraulic cylinder 110.

To permit the operator to control the position and movement of the gate 70, the gate control means 100 includes a user controlled valve 170 in flow communication with both the hydraulic power system 118 and the hydraulic cylinder 120 (when the dispensing bucket apparatus 10 is functionally attached to the loader vehicle 110). The user controlled valve 170 regulates the flow of hydraulic fluid from the hydraulic power system 118 to the hydraulic cylinder 120. The user controlled valve 170 includes a standard control in the loader vehicle cab 112 that permits the operator to control the valve 170. Thus, the user controlled valve 170 is adapted and positioned for ready access and control by a user sitting within the loader vehicle 110. Such control may include a joystick or lever control, button control or a dial-type control among others.

Regardless of the manner in which the gate means 68 is opened and controlled, the bucket includes a unique feature by virtue of its shape. This unique feature is that the operator sitting within the loader vehicle 110 can see inside the bucket 20 when the bucket 20 is in a lowered position and can view the pour when the bucket 20 is in the pouring position. Thus, the operator is able to see inside the bucket 20 during filling and transport and is able to view the pour.

When the apparatus 10 is first connected to the loader vehicle 110, the bucket 20 is empty and the gate 70 is positioned in its closed position. The bucket 20 is generally in a lowered position relatively near the ground, but raised slightly therefrom. In this position, the bucket 20 is more easily filled with flowable material. Once the bucket 20 is filled, the operator drives the loader vehicle 110 to the pour site typically raising the bucket 20 only enough to avoid collision with the terrain. Each of these positions is generally referred to herein as the lowered position.

In this lowered position, the operator can see into the bucket because the peripheral wall 40 is sufficiently low, or short, that a user sitting in the loader vehicle 110 can look over the top of the peripheral wall 40 into the bucket 20. When the bucket 20 is empty, the peripheral wall 40 is short enough that an operator can look over the wall 40 and see the bottom of the gate 70. This allows the operator to watch the bucket being filled and gage the amount of flowable material being placed in the bucket 20. The operator's ability to see into the bucket 20 during filling is important to ensure that the bucket 20 is not overfilled. Overfilling may cause spillage or more critical harm such as damage to the loader vehicle 110 caused by exceeding the load capacity of the loader vehicle 110. Additionally, this design allows the operator to view the load during transport and adjust the loader vehicle 110 speed and route as needed to avoid spillage. Watching the flowable material permits the user to avoid extreme sloshing that may result in spillage.

When full, the flowable material level within the bucket 20 is relatively high. Also, as mentioned previously, the gate 70 opens from the bottom. Therefore when the gate 70 opens, the pressure of the flowable material forces the flowable material through the exit opening 60 without any—or very little—tilting of the bucket 20. As the flowable material exits the bucket 20 and the level of material drops, the flow rate through the exit opening 60 decreases. Thus, the operator will typically raise the bucket 20 and will tilt the front 24 downward. Gravity will then force the flowable material toward and through the exit opening 60. The operator may shake the bucket 20 by rapidly jogging the loader vehicle 110 controls to further enhance the movement of the flowable material from the bucket 20. The funnel design of the bucket 20 directs the flowable material to the exit opening 60. When the bucket 20 is tilted and in the process and position of pouring, it is said herein generally to be in the pouring position.

Figure 3:
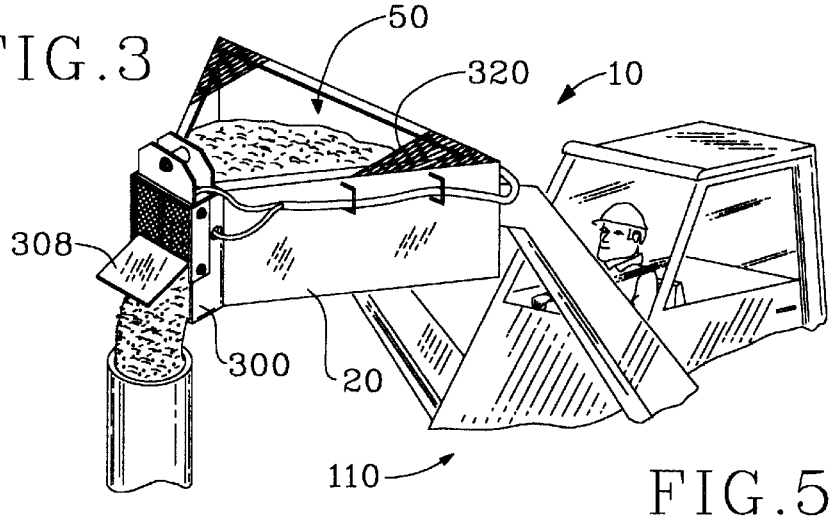
FIG. 3 is an isometric view of the dispensing bucket apparatus attached to a skid steer type loader vehicle making a pour into a tubular mold.

Preferably, the bottom 30 of the bucket is substantially flat, particularly its lower surface 34. This flat bottom 30 combined with the exit opening 60 that extends to the bottom 30 of the bucket 20 allows the operator to look along the bottom 30 and see the flowable material exiting the bucket 20 when the bucket is in the pouring position. This aspect of the invention is important because it facilitates accurate pours and reduces spillage. FIG. 3 illustrates the importance of accurate pouring. In that figure, the bucket 20 is being used to fill a tubular mold 270 with concrete. The mold 270 has a relatively small opening and the operator's ability to view the pour is vital to avoid waste. Although the figure shows the bucket in a raised position, the bucket 20 construction would allow the operator to view the pour equally well if the pour was being made near the ground, such as in a post hole. When lowered, the operator can also look into the bucket 20 over the peripheral wall 40 and watch the flowable material exit the bucket 20 from the inside. This allows the operator to view the pour before the bucket 20 is tilted. Further, the exit opening 60 and gate 70 are positioned in the front 24 of the bucket 20 in the natural direct line of sight of the operator of the loader vehicle 110 enhancing the operator's ability to oversee the pour.

Once substantially emptied, the operator returns the bucket 20 to its lowered position, closes the gate 70, and returns to obtain another load of flowable material. The process is then repeated.

Figure 10:
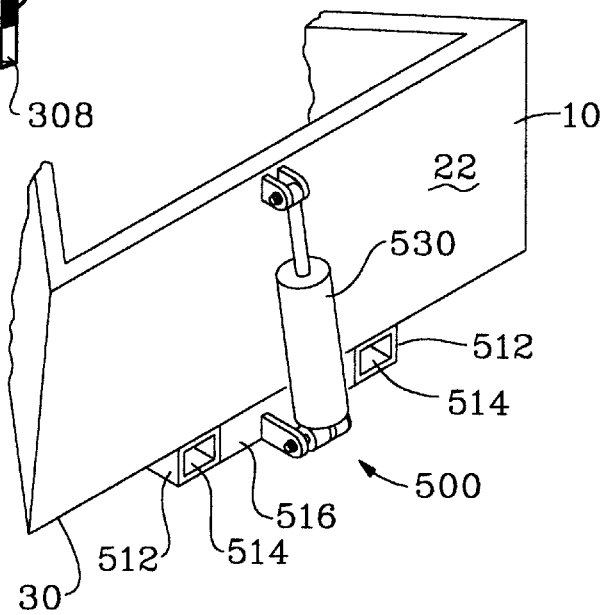
FIG. 10 is a partial isometric view of the dispensing bucket incorporating the tilting mechanism showing the back of the bucket.
Figure 9:
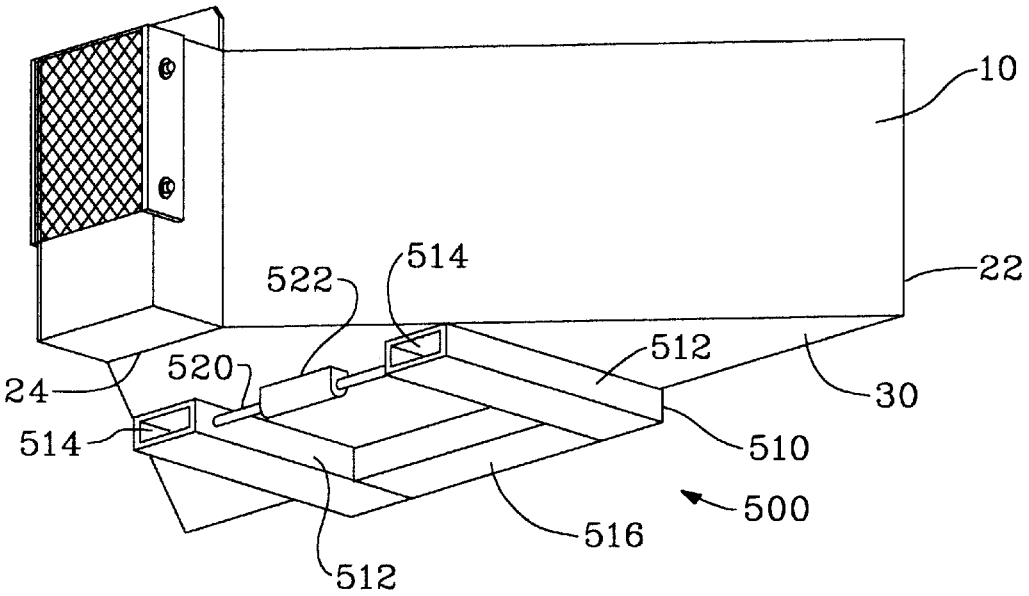
FIG. 9 is an isometric view of the dispensing bucket incorporating the tilting mechanism showing the bottom of the bucket.

As previously mentioned, tilting of the dispensing bucket apparatus 10 facilitates pouring of the flowable material. However, some forklifts are not equipped to provide adequate tilting. Therefore, one preferred embodiment of the present invention includes a tilting mechanism 500 that facilitates attachment to a standard forklift and tilting of the dispensing bucket apparatus 10. FIGS. 9 and 10 are isometric views of the dispensing bucket apparatus 10 incorporating a tilting mechanism 500. The preferred embodiment of the tilting mechanism 500 provides a frame 510 rotatably connected to the bottom 30 of the dispensing bucket apparatus 10 proximal the front 24 of the dispensing bucket apparatus 10 and a hydraulic cylinder 530 pivotally connected to the frame 510 and the back 22 of the dispensing bucket apparatus 10.

Although the tilting mechanism 500 is adapted for use with forklifts that do not provide for tilting, the tilting mechanism 500 may be used with any loader vehicle 110, even those that do allow for tilting of attached equipment. Using the tilting mechanism 500 allows the user to move the dispensing bucket apparatus 10 into position, open the gate 70, and then tilt the dispensing bucket apparatus 10 making the use of the dispensing bucket apparatus 10 easier for less experienced operators and preventing load shift.

The frame 510 includes two parallel side beams 512 that extend from the front 24 to the back 22 of the dispensing bucket apparatus 10. Each of the side beams 512 defines an inner cavity 514 that is sized and adapted to receive one of the lifting fingers of the forklift. Accordingly, the side beams 512 are spaced from one another a distance approximately equal to the distance between the lifting fingers of the forklift so that the frame 510 can receive both of the lifting fingers therein during use. A connecting beam 516 attached to the side beams 512 at their back ends extends perpendicular to the side beams 512 and maintains the relative position and orientation of the side beams 512. An axle 520 extends between and connects the side beams 512 near the front ends of the side beams 512 and also helps to maintain the relative position and orientation of the side beams 512. At least a portion of the axle 520 has a circular cross section.

A bearing block 522 fixedly attached to the bottom 22 of the dispensing bucket apparatus 10 defines a circular passageway therethrough adapted to rotatably receive the axle 520 therein. Accordingly, the axle 520 passes through the passageway of the bearing block 522 and is free to rotate relative thereto. The bearing block 522 and the axle 520 connect the front end of the frame 510 to the bottom 22 of the dispensing bucket apparatus 10 in such a way that the dispensing bucket apparatus 10 may rotate relative to the frame 510. The frame 510 defines a lower limit of the rotation for the dispensing bucket apparatus 10 because, in the resting position, the dispensing bucket apparatus 10 rests on the side beams 512 of the frame 510.

A hydraulic cylinder 530 is pivotally connected to the back end of the frame 510 and to the back 22 of the dispensing bucket apparatus 10 near the top of the back 22. The hydraulic cylinder 530 is in flow communication with the hydraulic power system 118 of the loader vehicle 110 and is adapted to raise and lower the back 22 of the dispensing bucket apparatus 10 in response to control of the hydraulic fluid to the hydraulic cylinder 530 by the user. Thus, using the hydraulic cylinder 530, the user can lift the back of the dispensing bucket apparatus 10 causing the dispensing bucket apparatus 10 to rotate in the bearing block 522 and tilt the dispensing bucket apparatus 10 so that the front 24 is lower than the back 22 of the dispensing bucket apparatus 10.

Preferably, the hydraulic cylinder 530 of the tilting mechanism 500 and the hydraulic cylinder 120 that controls the gate position are in fluid communication with one another. The hydraulic cylinders, 530 and 120, are connected so that, when the user controlling the hydraulic power system 118, moves the gate 70 to the open position, the tilting mechanism 500 lifts the back 22 of the dispensing bucket apparatus 10 tilting the dispensing bucket apparatus 10. Likewise, when the user moves the gate 70 to the closed position, the tilting mechanism 500 lowers the back 22 of the dispensing bucket apparatus 10. The weight of the dispensing bucket apparatus 10, particularly when full of a flowable material, exerts a downward force on the hydraulic cylinder 530 of the tilting mechanism 500 than the force required to raise and lower the gate 70. Therefore, the pressure required to move the hydraulic cylinder 120 and move the gate 70 to the open position is less than the pressure required to move the hydraulic cylinder 530 and tilt the dispensing bucket apparatus 10. Accordingly, when the user directs the hydraulic power system 118 to open the gate 70 and tilt the dispensing bucket apparatus 10, the hydraulic cylinder 120 controlling the gate 70 moves first and opens the gate. Then, when the gate 70 is fully opened, the hydraulic cylinder 530 of the tilting mechanism 500 lifts the back 22 of the dispensing bucket apparatus 10. Thus, connecting the hydraulic cylinders, 530 and 120, in fluid communication allows their control by a single controller and provides for sequential operation that first allows opening of the dispensing bucket apparatus gate 70 and then, when necessary, tilting of the dispensing bucket apparatus 10.

The tilting mechanism 500 may have a variety of embodiments. For example, the tilting mechanism 500 may have more than one bearing block 522 or may incorporate an adjustment means that permits the space between the side beams 512 to be adjusted. The alternate embodiments are anticipated and considered within the scope of the present invention.

Figure 11:
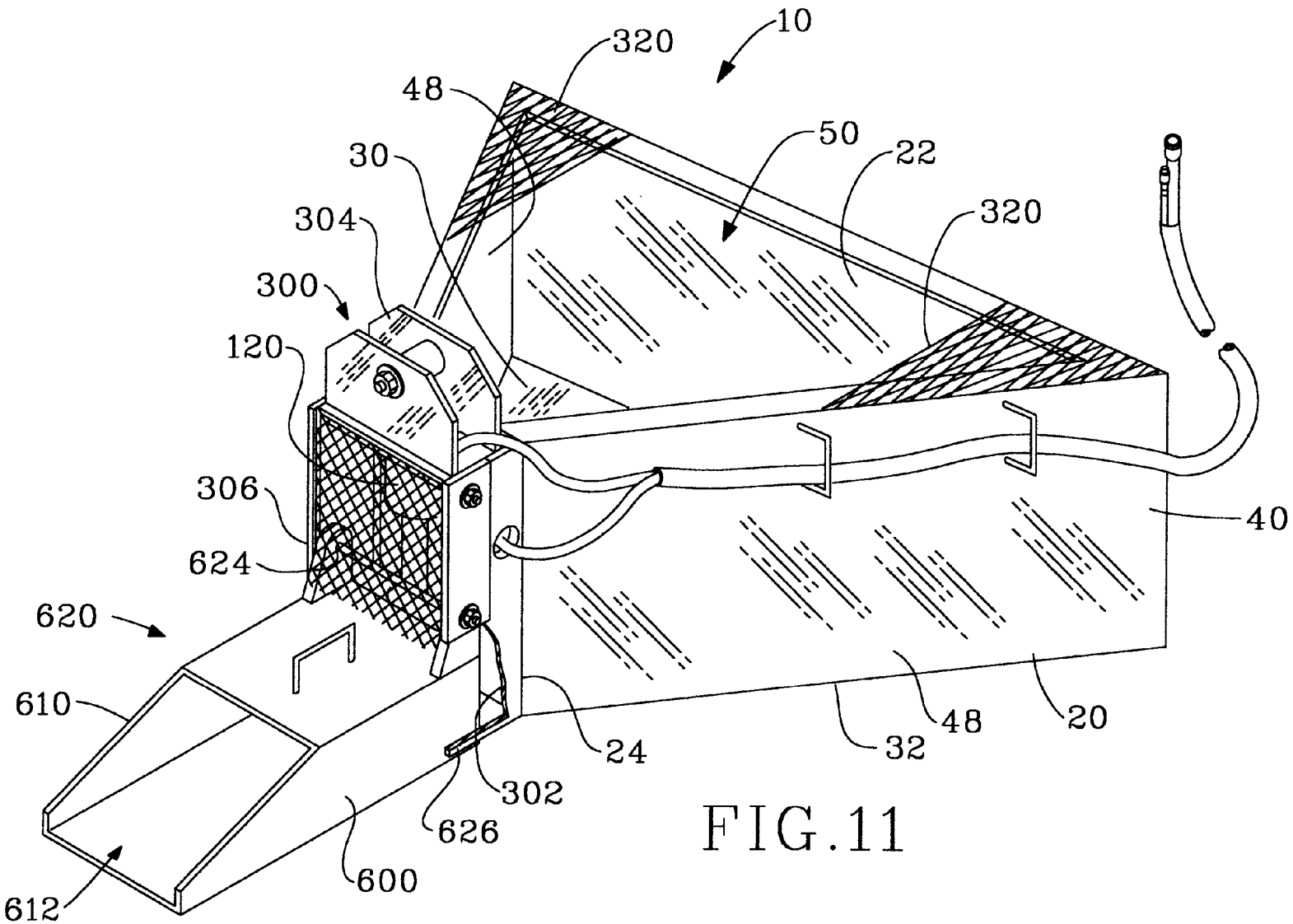
FIG. 11 is a partial cross sectional, isometric view of the dispensing bucket having a removable chute attached thereto.

FIG. 11 is a partial cross sectional isometric view of the dispensing bucket apparatus 10 having a removable chute 600 attached thereto. As mentioned, it is desirable, and often necessary, to move the pour opening as far from the loader vehicle 110 as possible. For example, when pouring a concrete wall, it may not be possible to position the loader vehicle 110 near enough to the mold 270 to effect the pour. Therefore, an apparatus for extending the pour opening further from the loader vehicle 110 is needed.

The chute 600 has a hollow, elongated body 610 defining an interior cavity 612 therein and means for attaching the chute 600 to the dispensing bucket apparatus 10. Typically, the chute 600 is attached to the front of the guard chute 302 with the bottom of the chute 600 co-planar or slightly below the bottom of the guard chute 302. Preferably, the flapper door 308 is removed and the chute 600 is attached at its top to the hinge holes provided for the flapper door 308 by one or more bolts or other suitable fasteners. As shown in FIG. 11, the hinge holes are typically behind the front cover 306. Therefore, the chute 600 has a pair of upwardly extending plates 622 that each have a bolt attachment hole 624 therethrough. The plates 622 and bolt holes 624 facilitate attachment of the chute 600 to the dispensing bucket apparatus 10. Proximal the bottom of the chute 600 at its back end is a groove 626 in each of the side walls of the chute 600. The grooves 626 are sized and adapted to receive the bottom of the guard chute 304 therein. The grooves 626 are positioned just above the upper surface of the bottom of the chute 600. The outer width of the chute 600 is slightly less than the width of the guard chute 302 so that the chute 600 extends partially into the guard chute 302 when attached to the dispensing bucket apparatus 10. Because the grooves 626 receive the bottom of the guard chute 302 the bottom of the chute 600 is positioned slightly below the bottom the guard chute 302. With this construction, the cavity 612 of the chute 600 has a cross sectional area that is substantially equal to the cross sectional area of a fully open exit opening 60. Therefore, the flow of flowable material is not restricted as it flows from the dispensing bucket apparatus 10 through the chute 600, but conversely, flows unimpeded therethrough.

The length of the chute 600 provides for a substantial additional offset from the front of the dispensing bucket apparatus 10. For example, the chute 600 may provide for an offset from the front of the dispensing bucket apparatus 10 of two feet, six inches or more. Although the preferred embodiment of the chute 600 has consistent cross sectional dimensions, the chute 600 could provide for further narrowing of the pour area, turning of the pour direction of the flowable material, splitting of the flowable material into two or more flow streams, widening of the pour area, or other similar modifications. A handle attached to the top of the chute 600 facilitates transport of the chute 600.

While the apparatuses and methods described herein are the preferred embodiments of the invention, the invention is not limited to these precise forms and changes may be made to the invention without departing from its scope.

I claim:

1. A controllable dispensing bucket apparatus comprising:

a bucket having an upper open portion adapted to receive a flowable material therein and an exit opening that is sufficiently large to permit the flowable material to exit therethrough;

the bucket adapted to be removably affixed to a loader vehicle;

gate means for selectively opening and sealingly closing the exit opening and controlling the size of the exit opening when the exit opening is open;

the gate means comprises:

a gate;

a pair of vertically extending slots on each side of the exit opening;

the gate extending between and slidably positioned in the slots;

so that the gate slides vertically in the slots to selectively open and sealingly close the exit opening and to control the size of the exit opening when the exit opening is open;

gate control means for actuating the gate means and controlling the position of the gate means—and, thus, the size of the exit opening—from within the loader vehicle when the bucket is functionally attached to the loader vehicle; and guard means for encasing and protecting the hydraulic cylinder and the gate while still permitting the flow of flowable material from the bucket.

2. An apparatus as claimed in claim 1 wherein the gate control means comprises:

a hydraulic cylinder having a movable ram;

the hydraulic cylinder attached to the bucket;

the movable ram attached to the gate;

the loader vehicle has a hydraulic power system;

the hydraulic cylinder in flow communication with and controlled by the hydraulic power system when the bucket is functionally attached to the loader vehicle;

so that a user in the loader vehicle controlling the hydraulic power system controls the hydraulic cylinder and the ram movement and, thus, the movement and position of the gate.

3. An apparatus as claimed in claim 1 wherein the guard means comprises:

the bucket has a front and a bottom;

the exit opening positioned at the front of the bucket;

a guard chute extends from the front of the bucket and has a front exit, a top, a bottom, and a pair of sides;

the guard chute has a height at least as great as the height of the bucket and a width at least as great as the width of the exit opening;

so that the guard chute encircles the exit opening and the gate;

the guard chute defines a cavity through which flowable material may flow;

the gate constructed so that when fully open it does not contact the top of the chute;

the bottom of the bucket and the bottom of the chute are level with one another;

a cylinder mounting bracket attached to the top of the guard chute;

the top of the guard chute defines a hole therethrough;

the hydraulic cylinder pivotally attached to the cylinder mounting bracket and extends downward through the hole in the top of the guard chute;

the guard chute is sufficiently long to enclose the hydraulic cylinder; and a porous front cover that extends the full width of the front exit of the guard chute and covers at least a portion of height of the front exit of the guard chute.

4. An apparatus as claimed in claim 3 further comprising;

a flapper door having a top and a bottom;

the flapper door extends the full width of the front exit of the guard chute;

the top of the flapper door connected to the front exit of the guard chute by a hinged connection intermediate the top and the bottom of the guard chute;

the flapper door extends downward so that its bottom is proximal the bottom of the guard chute; and the porous front cover the portion of the front exit of the guard chute not covered by the flapper door.

5. A dispensing bucket apparatus comprising:

a bucket having an upper open portion adapted to receive a flowable material therein and an exit opening that is sufficiently large to permit the flowable material to exit therethrough;

gate means for selectively opening and sealingly closing the exit opening and controlling the size of the exit opening when the exit opening is open;

the bucket adapted to be removably affixed to a forklift;

gate control means for actuating the gate means and controlling the position of the gate means—and, thus, the size of the exit opening—from within the forklift when the bucket is functionally attached to the forklift; and a tilting mechanism adapted to tilt the bucket relative to the forklift.

6. The apparatus of claim 5, wherein the tilting mechanism comprises:

the bucket having a front and a back and a top and a bottom;

a frame pivotally attached to a bottom of the bucket proximal the front of the bucket;

a hydraulic cylinder operatively attached to the frame and to the back of the bucket;

the forklift having a hydraulic power system;

the hydraulic cylinder in fluid communication with the hydraulic power system of the forklift when the bucket is functionally attached to the forklift; and so that a user controlling the hydraulic power system controls the hydraulic cylinder position and, thus, may effect lifting and lowering of the back of the bucket causing rotation and tilting of the bucket.

7. The apparatus of claim 6, further comprising the frame having a pair of side beams adapted and positioned to receive a forklift lifting finger therein.

8. The apparatus of claim 6, wherein:

the frame having an axle proximal its front end;

a bearing block attached to the bottom of the bucket defining a passageway therethrough adapted to rotatably receive the axle therein; and so that the axle and the bearing block rotatably connect the frame to the bucket.

9. The apparatus of claim 6, further comprising:

a hydraulic cylinder adapted to open and close the gate means in fluid communication with the hydraulic power system; and the hydraulic cylinder attached to the back of the bucket and adapted to lift and lower the back of the bucket and the hydraulic cylinder adapted to open and close the gate means in fluid communication with one another.

10. A dispensing bucket apparatus comprising:

a bucket having an upper open portion adapted to receive a flowable material therein and an exit opening that is sufficiently large to permit the flowable material to exit therethrough;

gate means for selectively opening and sealingly closing the exit opening and controlling the size of the exit opening when the exit opening is open;

the bucket adapted to be removably affixed to a loader vehicle;

a chute defining a cavity therethrough removably attachable to the bucket with the cavity in fluid communication with the exit opening; and so that the flowable material flows from the bucket, through the exit opening, and through the chute.

11. The apparatus of claim 10, wherein the cross sectional area of the cavity of the chute is substantially equal to the cross sectional area of the exit opening when the exit opening is fully open.

12. The apparatus of claim 10, wherein the width of the cavity of the chute is substantially equal to the width of the exit opening and the height of the cavity of the chute is at least as great as the height of the exit opening when the exit opening is fully open.

13. The apparatus of claim 10, wherein a bottom of the cavity of the chute is slightly below the bottom of the exit opening.

14. The apparatus of claim 10, wherein the chute has a length of at least one foot.

15. The apparatus of claim 10, wherein the chute has a length of at least two feet.

16. The apparatus of claim 10, wherein the chute has a length of at least two feet, six inches.

* * * * *